US008985472B2

(12) United States Patent
Peterman et al.

(10) Patent No.: US 8,985,472 B2
(45) Date of Patent: Mar. 24, 2015

(54) WIRELESS TEMPERATURE SENSING AND CONTROL SYSTEM FOR METAL KILN AND METHOD OF USING THE SAME

(75) Inventors: John M. Peterman, Weldon Spring, MO (US); Mark A. Roberts, St. Charles, MO (US)

(73) Assignee: Gillespie + Powers, Inc., St. Louis, MO (US)

( * ) Notice: Subject to any disclaimer, the term of this patent is extended or adjusted under 35 U.S.C. 154(b) by 743 days.

(21) Appl. No.: 13/111,633

(22) Filed: May 19, 2011

(65) Prior Publication Data

US 2011/0287375 A1 Nov. 24, 2011

Related U.S. Application Data

(60) Provisional application No. 61/346,199, filed on May 19, 2010.

(51) Int. Cl.

| | |
|---|---|
| ***F24H 9/20*** | (2006.01) |
| ***F27D 19/00*** | (2006.01) |
| ***F27B 7/42*** | (2006.01) |

(52) U.S. Cl.

CPC .. *F27D 19/00* (2013.01); *F27B 7/42* (2013.01)
USPC ..... 236/10; 236/15 R; 236/51

(58) Field of Classification Search

USPC ..... 236/51, 1 A, 10, 15 R, 15 BR, 15 BB; 432/72, 106; 110/204, 210, 211, 214, 110/246

See application file for complete search history.

(56) References Cited

U.S. PATENT DOCUMENTS

| | | | | |
|---|---|---|---|---|
| 4,004,219 | A * | 1/1977 | Tiuri et al. | 324/632 |
| 4,176,554 | A * | 12/1979 | Kazmierowicz | 374/137 |
| 6,227,847 | B1 * | 5/2001 | Gillespie | 432/72 |

FOREIGN PATENT DOCUMENTS

| | | |
|---|---|---|
| JP | 2001004283 A | 1/2001 |
| JP | 2001280849 | 10/2001 |
| JP | 2003176985 | 6/2003 |

OTHER PUBLICATIONS

PCT International Search Report dated Dec. 9, 2011, for the International Application No. PCT/US2011/037163, International Filing Date May 19, 2011.

PCT Written Opinion of the International Searching Authority dated Dec. 9, 2011, for the International Application No. PCT/US2011/037163, International Filing Date May 19, 2011.

* cited by examiner

*Primary Examiner* — Marc Norman
(74) *Attorney, Agent, or Firm* — Polster, Lieder, Woodruff & Lucchesi, L.C.

(57) ABSTRACT

A rotary aluminum kiln temperature regulation system comprising a temperature sensing device in the kiln that is configured to take temperature readings in an area of the kiln in proximity to the temperature sensing device. The system including a wireless transmitter operatively associated with the temperature sensing device and a receiver wirelessly associated with the transmitter, such that the transmitter and receiver wirelessly transmit the temperature readings taken by the temperature sensing device from the transmitter to the receiver. The system also including a control unit operatively connected to the receiver that is configured to receive the transmitted temperature readings and determine when the transmitted temperature readings exceed a predefined temperature setpoint. The control unit is operatively connected to a heat flow control device that can adjust heat flow inside the kiln in proximity to the temperature sensing device, such that the control unit regulates the heat flow control device to maintain a desired level of heat flow in the kiln in proximity to the temperature sensing device in response to the temperature readings transmitted from the temperature sensing device.

16 Claims, 1 Drawing Sheet

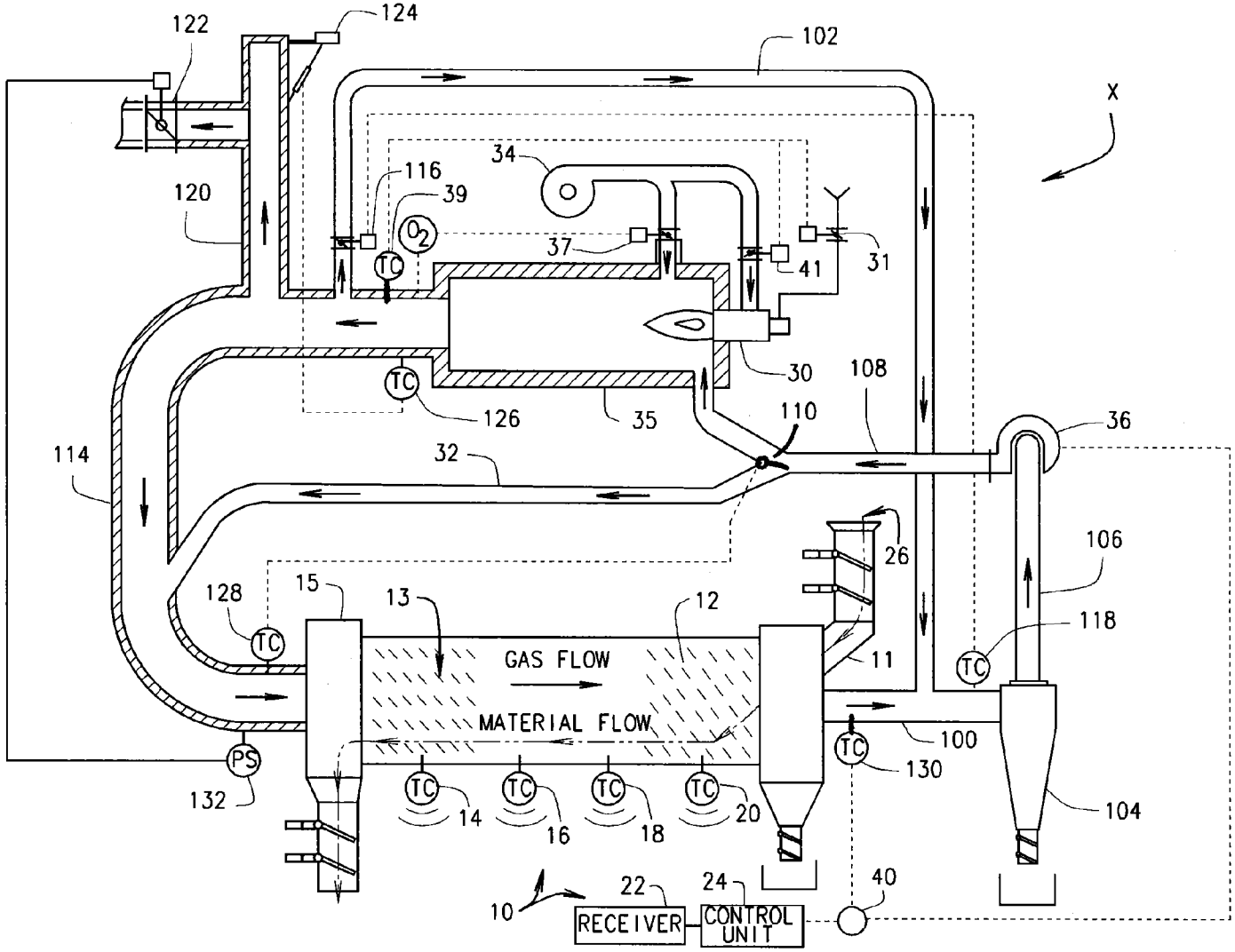
X
36
106
118
104
TC
100
130
40
26
11
108
31
41
30
110
102
CONTROL UNIT
24
20
12
RECEIVER
22
18
35
GAS FLOW
MATERIAL FLOW
16
10
37
34
126
32
14
39
116
13
124
15
128
PS
132
122
120
114

WIRELESS TEMPERATURE SENSING AND CONTROL SYSTEM FOR METAL KILN AND METHOD OF USING THE SAME

CROSS REFERENCE TO RELATED APPLICATIONS

This application derives and claims priority from U.S. provisional application 61/346,199 filed 19 May 2010, which application is incorporated herein by reference.

STATEMENT REGARDING FEDERALLY SPONSORED RESEARCH OR DEVELOPMENT

Not applicable.

BACKGROUND OF THE INVENTION

This invention relates principally to a metal furnace or kiln, and more particularly to a temperature sensing and control system for rotary aluminum delacquering kilns using wireless thermocouples or comparable temperature sensing devices.

It has for some time been a standard practice to recycle scrap metals, and in particular scrap aluminum. Various furnace and kiln systems exist that are designed to recycle and recover aluminum from various sources of scrap, such as used beverage cans ("UBC"), siding, windows and door frames, etc. One of the first steps in these processes is to use a rotary kiln to remove the paints, oils, and other surface materials on the scrap aluminum (i.e. "feed material"). This is commonly known in the industry as "delacquering." Delacquering is typically performed in an atmosphere with reduced oxygen levels and temperatures in excess of 900 degrees Fahrenheit. The temperature at which the paints and oils and other surface materials are released from the aluminum scrap in the form of unburned volatile gases is known as the "volatilization point." One such typical aluminum recycling system utilizes a rotary kiln to delacquer the aluminum. Many of these systems utilize a recirculating heat apparatus comprising a burner with a blower to direct heat into the kiln, and a recovery device that collects exhaust heat from the kiln and recirculates the recovered heat into the heat flow for the kiln.

Due to the difficulties in accessing the rotating material during operation, the temperatures in traditional rotary aluminum kilns are not regularly monitored. Sensing devices external of the kiln are sometimes used as a temperature testing method. This requires manual intervention and is not particularly accurate. Unfortunately, failure to consistently and accurately monitor the conditions in the kiln can lead to fires. These fires result when the feed material reaches the volatilization point too rapidly and the feed material begins to rapidly oxidize and generate its own heat, leading to a high temperature excursion (i.e. "overtemp event"). Applicants have learned through tests, utilizing wireless high temperature thermocouples placed in the kiln, that certain temperature profiles occur in the feed material that can be used as precursors to predict such high temperature excursions or overtemp events, and that such events can arise in as little as 10 minutes of operation and can arise in different locations within the kiln. Further, applicants have learned through testing that controlling the heat flow into the kiln can regulate and prevent such overtemp events. These overtemp events can occur at different positions along the length of the feed material in the kiln, and may be affected by such variables as the size of the feed material put into the kiln, the moisture content of the feed material, the volume of the feed material and the feed rate, the composition of the feed material, and the cleanliness of feed material. A fire in a rotary aluminum kiln can require a costly shut-down, will likely destroy the feed material, and can damage the kiln and other associated equipment.

One example of a condition that can lead to an overtemp event concerns the presence of magnesium in aluminum feed material. Most aluminum cans (e.g. UBC's) have lids or tops that comprise a higher percentage of magnesium than the body of the can. Magnesium melts at a lower temperature than aluminum, and is very combustive. When placed in a rotary aluminum kiln, the aluminum can lids can separate from the aluminum can body. This is known in the industry as "lid fracturing". This lid fracturing reduces the lids to particles of aluminum and magnesium as small as a grain of sand. Oxidation of these particles in the kiln occurs very rapidly, resulting in highly combustible partially oxidized aluminum and magnesium. The amount of heat in the kiln must be reduced or the partially oxidized aluminum and magnesium can accelerate in temperature and ignite in the kiln. Like other overtemp events, such UBC lids fracture events can be localized to one or more zones within the kiln. However, once ignition occurs the fire can flash rapidly throughout the kiln.

As will become evident in this disclosure, the present invention provides benefits over the existing art.

BRIEF DESCRIPTION OF THE DRAWINGS

The illustrative embodiments of the present invention are shown in the following drawings which form a part of the specification:

FIG. 1 is a schematic of an aluminum rotary kiln delacquring system incorporating one embodiment of the present invention;

Corresponding reference characters indicate corresponding parts throughout the several views of the drawings.

DETAILED DESCRIPTION

In referring to the drawings, a schematic embodiment of the novel wireless temperature sensing and control system for metal kiln 10 of the present invention is shown generally in FIG. 1, where the present invention is depicted by way of example as integrated into a representative mass flow delacquering system X with a rotary aluminum kiln 12 having a delacquering zone 13 within the kiln 12. As can be seen, a set of four independent high temperature thermocouples 14, 16, 18 and 20, are positioned along the length of the kiln 12. In practice, the thermocouples 14, 16, 18 and 20 are positioned with at least the temperature sensing portion of the thermocouple exposed to the delacquering zone 13 within the rotary kiln 12. All of the thermocouples 14, 16, 18 and 20 are configured to detect temperature readings in the kiln 12, including temperature readings in excess of the melting point of aluminum, and are further configured to transmit the temperature readings they sense inside of the kiln 12 via radio signals to a receiving device or receiver 22 that is external of the kiln 12. Alternately, the thermocouples 14, 16, 18 and 20 could be operatively connected to a wireless transmitter (not shown) that would transmit the temperature readings to the receiving device or receiver 22.

Aluminum feed material 26, which is ready for the delaquering process, is supplied to the kiln 12 through a feed material control chute 11, which regulates the rate at which the feed material is supplied to the kiln 12. The material then travels through the kiln 12 as the kiln 12 rotates about its central axis, and the material 26 is then discharged through a discharge chute 15, which regulates the rate at which feed material is discharged from the kiln 12. In order to reach and maintain temperatures sufficient to delacquer aluminum feed material 26 in the depicted system X, the kiln 12 receives heated air from a burner 30 and a burner bypass pipe 32. The burner 30 receives ambient temperature air, at a temperature of approximately 70 degrees F., from a combustion blower 34 and recirculated gases, at a temperature of approximately 500 degrees F., from a variable speed recirculation blower 36 which in turn receives the recirculated heated gases that have passed through the kiln 12. Combustion gases are controllably supplied to the burner 30 through a mass flow controller 31. The combustion blower 34 also drives the ambient temperature air into an afterburner 35 attached to the burner 30. Oxygen can be controllably injected as desired directly into the afterburner 35 through a mass flow controller 37. A thermocouple 39 positioned near the exit for the afterburner 35 takes temperature readings of the gases as they exit the afterburner. The thermocouple 39 connects to the combustion gas mass flow controller 31 and a mass flow controller 41, positioned between the combustion blower 34 and the burner 30, such that the mass flow controllers 31 and 41 regulate the flow of combustion gases and air, respectively, in response to the temperature readings from the thermocouple 39, so as to automatically control the burner operation to control the temperature of the gases supplied through a supply pipe 114.

Because the recirculation blower 36 simultaneously supplies preheated air to the burner 30 and the kiln 12, the volume of heated air supplied to the kiln 12 in system X can be predictably controlled by varying the speed of the blower 36. Because the volume of heated air supplied to the kiln 12 in turn affects the amount of heat injected into the kiln 12 and thereby to the feed material 26 in the delacquering zone 13 within the kiln 12, varying the speed of the blower 36 has a and controllable predictable impact on the amount of heat applied to the feed material 26 in the delacquering zone 13.

The receiver 22 is operatively connected to a programmable control unit 24, although in other configurations the control unit 24 can comprise the receiver 22. Of course, wires or wireless devices may alternatively be used to operatively connect components positioned outside the kiln 12 or outside the gas and material flow components of the system X. Hence, for example, the receiver 22 may be wired to or wirelessly connected to the control unit 24. The kiln temperatures transmitted from the thermocouples 14, 16, 18 and 20 to the receiver 22 are communicated to the control unit 24. In traditional configurations, an automated feedback loop adjusts the speed of the blower 36 in response to the quantity and rate of feed material directed into the kiln 12. In the present configuration of FIG. 1, the control unit 24 is operatively connected to and controls a mass flow controller 40 that regulates the speed of the recirculation blower 36, and thereby the heat applied to the feed material 26 in the delacquering zone 13 within the kiln 12. The control unit 24 may be wired to or wirelessly connected to the mass flow controller 40. The control unit 24 automatically controls the speed of the blower 36, using commands to the mass flow controller 40, based upon a predetermined process loop control algorithm programmed into the control unit 24.

As seen in FIG. 1, in a representative mass flow delacquering system X, gases exiting the kiln 12 travel through an exit pipe 100, where a bypass pipe 102 joins the exit pipe 100. The temperature of the gases traveling in this area of the system X is approximately 500 degrees F. The gases are then directed into a cyclone 104, through an inlet pipe 106 into the recirculating blower 36. The blower 36 both draws the gases from the cyclone 104 and pushes the gases into supply pipe 108. A diverter valve 110 is positioned at a junction along the pipe 108 to direct the gas flow into an afterburner 35 or through the burner bypass pipe 32. Gases directed into the afterburner 35 are subjected to the heat generated by the burner 30, where the gas temperature is raised to approximately 1500 degrees F. The gases are then directed out of the afterburner 35 and directed along the supply pipe 114 to the kiln 12.

Near the afterburner 35, the bypass pipe 102 is connected to the supply pipe 114, where a portion of the gases are diverted to the exit pipe 100. The amount of gas that is allowed to exit through the bypass pipe 102 is controlled by a bypass valve 116. The bypass valve 116 is, in turn, connected to a thermocouple 118 in the exit pipe 100, and the valve 116 opens and closes in response to the temperature readings supplied by the thermocouple 118.

Downstream from the junction of the bypass pipe 102 and the supply pipe 114, a vent pipe 120 joins the supply pipe 114. The vent line connects to a pressure control damper 122 and, through which the gas pressure in the system X can be controlled. In addition, an emergency vent stack 124, that is triggered by temperature readings supplied from a thermocouple 126 in the supply pipe 114 near the exit for the afterburner, connects to the vent pipe to provide for a safety pressure relief for the system X.

Before entering the kiln 12, the supply pipe 114 is joined by the burner bypass pipe 32. By utilizing the diverter valve 110 to controllably combining the higher temperature gases supplied by the afterburner with the lower temperature gases supplied by the bypass 32, the user can regulate the temperature of the gases supplied to the kiln 12. A nominal target temperature for a typical delaquering operation is approximately 1100 degrees F. The diverter valve 110 is connected to a thermocouple 128 in the supply pipe 114 near the entrance to the kiln 12, and the valve 110 rotates to control the ratio of gases directed into the afterburner 35 as opposed to the bypass 32, in response to the temperature readings supplied by the thermocouple 128.

A thermocouple 130 near the junction of the kiln 12 and the exit pipe 100 takes temperature readings of the gases as they exit the kiln 12. This temperature data provides an additional source of information to alternatively control the mass flow controller 40. The temperature readings from thermocouple 130 may be used separate from or in conjunction with the operation of the control unit 24.

A pressure sensor 132 is positioned in the supply pipe 114 near the entrance to the kiln 12. The pressure sensor 132 is connected to and controls the pressure control damper 122 in the vent stack 120.

Upon initial setup, the wireless thermocouples 14, 16, 18 and 20 can be used to profile the temperatures along the inner length of the kiln 12. This profile is then programmed into the control unit 24 as a baseline from which overtemp events are detected and to which a response is performed. During operation of the system X, the control unit 24 constantly and automatically monitors the kiln 12 via the temperatures received from each of the wireless thermocouples 14, 16, 18 and 20. The algorithm in the control unit 24 is programmed to use the baseline profile to monitor for spikes or unacceptable increases in temperature in the feed material 26 in the delacquering zone 13 within the kiln 12, and automatically control the heat supplied to the kiln 12 to prevent fires in the kiln 12 and otherwise maintain a proper operational delacquering profile within the kiln 12.

In a simple form, and by way of example, should any one or more of the thermocouples 14, 16, 18 and 20, detect a temperature that exceeds a predetermined high limit setpoint for a period of time that exceeds a predetermined duration, or should one or more of the thermocouples 14, 16, 18 and 20, detect an abnormal temperature pattern in the kiln 12 such as a rapid rise in temperature, the control unit 24 then automatically instructs the mass flow controller 40 to decrease the speed of the blower 36 a predetermined amount based upon the anticipated reduction in heat that is necessary to avoid a fire in the kiln 12, as formulated from tests and calculations. Should the temperatures in the kiln 12 drop below a lower limit setpoint for a period of time that exceeds a duration setpoint, the control unit 24 then automatically instructs the mass flow controller 40 to increase the speed of the blower 36 a predetermined amount based upon the anticipated increase in heat that is necessary to properly operate the kiln 12, also as formulated from tests and calculations. Of course, one skilled in the art will recognize that much more complex algorithms may be incorporated in the control unit 24 to enable refined control of the temperature profile of the feed material 13 and the and the efficiency of the kiln 12.

In an even more simplified variant of the novel wireless temperature sensing and control system for metal kiln 10 of the present invention (not shown), there is no control loop to automatically control the heat supplied to the kiln 12. Rather, when an overtemp event is identified by the control unit 24 from the wireless thermocouples 14, 16, 18 and 20, such as for example when any one or more of the thermocouples 14, 16, 18 and 20, detects a temperature that exceeds a predetermined high limit temperature setpoint for a period of time that exceeds a predetermined duration, or should one or more of the thermocouples 14, 16, 18 and 20, otherwise detect an abnormal temperature pattern in the kiln 12 such as a rapid rise in temperature, the control unit 24 generates a notification. The notification can activate a notification apparatus, such as triggering an alarm (not shown) to alert the system X operators of a potential fire threat in the kiln 12. The system X operators can then inspect the situation and make any manual or automated adjustments to the system X operation as they see fit.

Of course, the programmable control unit 24 may be operatively connected to and control in response to the temperature readings from any one or more of the thermocouples 14, 16, 18 and 20, any one or more of the heat flow control devices in the system X, which include for example and without limitation, the pressure control damper 122, the combustion blower 34, the combustion oxygen supply mass flow controller 37, the combustion gas mass flow controller 31, the combustion air mass flow controller 41, the diverter valve 110, the emergency vent 124, the bypass valve 116, the feed material control chute 13 and the feed material discharge chute 15.

While we have described in the detailed description two configurations that may be encompassed within the disclosed embodiments of this invention, numerous other alternative configurations, that would now be apparent to one of ordinary skill in the art, may be designed and constructed within the bounds of our invention as set forth in the claims. Moreover, both of the above-described novel wireless temperature sensing and control system for metal kiln 10 of the present invention can be arranged in a number of other and related varieties of configurations without expanding beyond the scope of our invention as set forth in the claims.

For example, the system 10 is not necessarily required to be installed in a mass flow delacquering system X as depicted in FIG. 1, but may be installed or otherwise incorporated into a variety of configurations of metal recycling furnace and kiln systems. Further, the system 10 is not constrained to the use of four wireless thermocouples such as 14, 16, 18 and 20. Rather, the system 10 may comprise any number of wireless thermocouples (or other temperature sensing devices), from as few as a single wireless thermocouple up to numerous more than four wireless thermocouples. Likewise, the system 10 is not restricted to a single receiver 22 or a single control unit 24. Depending on the configuration of the recycle system and rotary kiln application, the system 10 may require or it may be desirable to utilize two or more receivers, such as the receiver 22, or two or more control units, such as the control unit 24. In addition, the system 10 is not restricted to using thermocouples, but may utilize any form of temperature sensing device that can be adapted for use in the furnace or kiln environment for which the system 10 is designed.

By way of further example, depending on the configuration of the melt system, it may be necessary or otherwise desirable to include in the system 10 one or more mass flow controllers or other such heat flow control devices in the recycle system X that are capable of adjusting the heat flow in the kiln 12. These other heat flow control devices may be positioned at various locations in the recycle system. Such heat flow control devices may include, for example, a cooling injection port, controllers for various gas supply lines to one or more burners in the melt system, and mechanical in-line dampers for gas flow. It would be recognized by one of ordinary skill in the art that any mechanism that can be manipulated to control the heat flow in the kiln 12 may potentially be incorporated into the system 10. Each of these heat flow control devices can be operatively connected to the control unit 24 such that the control unit 24 regulates the heat flow control devices in response to the temperature readings transmitted to the control unit 24 from the thermocouples 14, 16, 18 and 20. Further, the control unit 24 can be programmed to regulate the heat flow control devices in varying patterns depending on the profile of the temperature readings across the thermocouples 14, 16, 18 and 20, and the durations of those temperature readings at or about any one or more predetermined temperature setpoints.

Additional variations or modifications to the configuration of the novel wireless temperature sensing and control system for metal kiln 10 of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of our invention.

What is claimed is:

1. A method for controlling a material processing apparatus comprising a rotary kiln, the kiln having an inlet for supplying material to the kiln at a feed rate for processing of the material in the kiln, an outlet for removal of the material from the kiln after processing, and a process zone positioned between the inlet and outlet through which the material moves for processing; the apparatus having a heat source external to the kiln, said heat source supplying heat into the kiln through one of said inlet and said outlet; the process zone having a plurality of temperatures therein positioned at intervals between said inlet and said outlet; the processing apparatus further comprising a plurality of temperature sensors, each of said sensors adapted to measure a temperature at a different location within the process zone positioned at differing distances between said inlet and said outlet and to generate a signal indicative of the temperature so measured; the apparatus further comprising one or more process control loops external to the process zone, each of said process control loops indirectly regulating at least in part one or more of the plurality of temperatures within the process zone; the apparatus further comprising a programmable microprocessor control unit operatively associated with and controlling at least in part each of said process control loops; the method comprising:

a. storing a temperature control profile in the control unit;

b. receiving at the control unit the signals from the plurality of temperature sensors;

c. the control unit determining the temperature at each of the locations in the process zone and creating a process temperature profile of the process zone there from;

d. the control unit comparing the process temperature profile with the temperature control profile to create a temperature profile comparison; and e. the control unit operating one or more of the operation control loops in response to the temperature profile comparison in order to adjust the temperature at one or more of the locations in the process zone in order to substantially match the process temperature profile to the temperature control profile.

2. The method of claim 1, wherein the processing apparatus comprises one or more of the following process control loops operatively associated with the control unit:

i. an overtemp control loop;

ii. a material feed rate control loop;

iii. a return blower speed control loop;

iv. a kiln rotation speed control loop;

v. a return gas diverter valve control loop;

vi. a combustion gas control loop;

vii;

viii. an exhaust damper control loop;

xi. an emergency vent control loop; and/or x. an oxygen control loop;

the method further comprising one or more of said process control loops sensing an operational condition outside of the process zone that influences one or more of said plurality of process zone temperatures, and each of said one or more process control loops communicating a signal indicative of its respective operational condition to the control unit; the method further comprising the control unit receiving and utilizing each said communicated signal to operate one or more of the process control loops in response to one or more of said operational conditions to substantially match the process temperature profile to the temperature control profile.

3. The method of claim 2, wherein the process zone comprises a plurality of reaction zones, the temperature control profile comprises a plurality of temperature ranges, and each of said temperature ranges corresponds to one of said reaction zones, each of said plurality of temperature sensors being positioned in a different one of said reaction zones, the temperature control profile being segmented into zones corresponding in position to said reaction zones to create a reaction zone temperature profile; the method further comprising the control unit creating a correlation between the temperatures measured for each said reaction zone and the temperature range from the temperature control profile corresponding to said reaction zone.

4. The method of claim 2, wherein the material feed rate control loop comprises a variable feed rate mechanism operationally controlled by the control unit such that increasing the feed rate increases the volume of process material in the kiln to decrease the temperature in the kiln and decreasing the feed rate decreases the volume of process material in the kiln to increase the temperature in the kiln; the method further comprising the control unit instructing the feed rate mechanism to increase the feed rate when the process temperature profile indicates a temperature in proximity to the inlet that is greater than the corresponding temperature in the process control profile in proximity to the inlet, and instructing the feed rate mechanism to decrease the feed rate when the process temperature profile indicates a temperature in proximity to the inlet that is lower than the corresponding temperature in the process control profile in proximity to the inlet.

5. The method of claim 2, wherein the return blower speed control loop comprises a recirculation blower and a speed control mechanism that controls the operating speed of the blower, the blower directing exhaust air from the kiln back into the kiln, the speed control mechanism being operationally controlled by the control unit such that increasing the blower speed increases the temperature in the kiln and reducing the blower speed decreases the temperature in the kiln; the method further comprising the control unit instructing the speed control mechanism to increase the blower speed when the process temperature profile indicates a temperature in one or more of the reaction zones that is lower than the corresponding temperature in the process control profile, and instructing the speed control mechanism to decrease the blower speed when the process temperature profile indicates a temperature in one or more of the reaction zones that is greater than the corresponding temperature in the process control profile.

6. The method of claim 2, wherein the kiln rotation speed control loop comprises a variable speed drive that rotates the kiln and a speed control mechanism that controls the operating speed of the drive, the speed control mechanism being operationally controlled by the control unit such that increasing the kiln rotation speed increases the rate at which process material travels through the kiln and increases the temperature in the kiln, and that decreasing the kiln rotation speed decreases the rate at which process material travels through the kiln and reduces the temperature in the kiln; the method further comprising the control unit instructing the speed control mechanism to increase the kiln rotation speed when the process temperature profile indicates a temperature in one or more of the reaction zones that is greater than the corresponding temperature in the process control profile, and instructing the speed control mechanism to decrease the kiln rotation speed when the process temperature profile indicates a temperature in one or more of the reaction zones that is lower than the corresponding temperature in the process control profile.

7. The method of claim 2, wherein the apparatus heat source comprises a burner, the return gas diverter valve control loop comprises an expandable opening that regulates the volume of gas exiting the kiln that is directed to the burner, the valve being operationally controlled by the control unit such that expanding the valve opening increases the volume of return gas directed to the burner to reduce the temperature of the gases entering the kiln, and reducing the valve opening decreases the volume of return gas entering the burner to increase the temperature of the gases entering the kiln; the method further comprising the control unit instructing the return gas diverter valve to expand the valve opening when the process temperature profile indicates a temperature in one or more of the reaction zones that is greater than the corresponding temperature in the process control profile, and instructing the return gas diverter valve to reduce the valve opening when the process temperature profile indicates a temperature in one or more of the reaction zones that is lower than the corresponding temperature in the process control profile.

8. The method of claim 2, wherein the apparatus heat source comprises a burner, the combustion gas control loop comprises a mass flow controller that regulates the flow of combustion gas entering the burner, the mass flow controller being operationally controlled by the control unit such that increasing the flow of combustion gas into the burner increases the temperature in the kiln and decreasing the flow of combustion gas into the burner decreases the temperature in the kiln; the method further comprising the control unit instructing the mass flow controller to increase the flow of combustion gas into the burner when the process temperature profile indicates a temperature in the kiln that is lower than the corresponding temperature in the process control profile, and instructing the mass flow controller to decrease the flow of combustion gas into the burner when the process temperature profile indicates a temperature in the kiln that is greater than the corresponding temperature in the process control profile.

9. The method of claim 2, wherein the exhaust damper control loop comprises an exhaust valve with an expandable opening that regulates the volume of exhaust gas allowed to exit the apparatus, the valve being operationally controlled by the control unit such that expanding the opening increases the volume of exhaust gas allowed to exit the apparatus to reduce the gaseous pressure in the kiln and reducing opening decreases the volume of exhaust gas allowed to exit the apparatus to increase the gaseous pressure in the kiln; the apparatus further comprises an oxygen sensor positioned to sense the oxygen level of the kiln, the oxygen sensor communicating said oxygen level to the control unit; the apparatus further comprises a gas pressure sensor positioned to sense the gaseous pressure in proximity to the kiln, the pressure sensor communicating said pressure to the control unit; the control unit being adapted to correlate one or more of said oxygen level, said gaseous pressure and the process temperature profile, to detect a potential flash condition in the kiln and to determine when said potential flash condition subsides; the method further comprising the control unit instructing the exhaust valve to reduce the opening when the control unit detects the potential flash condition in the kiln, and instructing the exhaust valve to increase the opening when the control unit determines that the potential flash condition has subsided.

10. The method of claim 9, wherein the emergency vent control loop comprises a vent valve operatively associated with the control unit, the vent valve opening to exhaust the gases in the apparatus to atmosphere; the control unit further adapted to correlate one or more of said oxygen level, said gaseous pressure and the process temperature profile, to detect a flash condition in the kiln and to determine when said flash condition subsides; the method further comprising the control unit instructing the vent valve to open when the control unit detects flash condition in the kiln.

11. The method of claim 2, wherein the oxygen control loop comprises an oxygen sensor and an oxygen flow controller, the oxygen sensor sensing the oxygen level in proximity to the kiln and communicating said oxygen level to the control unit, the oxygen flow controller operatively communicating with an oxygen source to control the flow of oxygen from said source into the kiln, said oxygen flow controller being operatively associated with the control unit; the feed rate control loop comprises a variable feed rate mechanism operationally controlled by the control unit such that increasing the feed rate increases the volume of process material and heat in the kiln and decreasing the feed rate decreases the volume of process material and heat in the kiln, the feed rate control loop communicating the feed rate to the control unit; the apparatus further comprising a material control chute that communicates to the control unit the rate at which process material is directed into the kiln through the chute;

the method further comprising providing the control unit with a volatization coefficient for the process material being placed into the kiln; the control unit calculating the volume of process material in the kiln; the control unit using the volalization coefficient, the feed rate and the volume of process material in each reaction zone, at least in part, to determine a process temperature for the kiln to outgas volatiles from the process material without a flash over; the control unit determining a target oxygen level for the kiln to substantially exhaust the volatiles from the process material in the kiln without a flash over; the control unit determining the oxygen level in the kiln from the oxygen sensor; and the control unit instructing the oxygen flow controller to release oxygen into the kiln as needed to maintain the target oxygen level.

12. A method for controlling a material processing apparatus comprising a rotary kiln, the kiln having an inlet for supplying material to the kiln at a feed rate for processing of the material in the kiln, an outlet for removal of the material from the kiln after processing, and a process zone positioned between the inlet and outlet through which the material moves for processing; the apparatus having a heat source external to the kiln, said heat source supplying heat into the kiln through one of said inlet and said outlet; the apparatus further comprising a plurality of temperature sensors positioned at intervals along the length of the process zone from the inlet to the outlet, each of said sensors measuring a temperature in one of a plurality of different process regions in the process zone and generating a signal indicative of the temperature so measured, each of said regions having a process temperature therein;

the apparatus further comprising a plurality of process control loops external to the process zone, each of said process control loops indirectly regulating at least in part one or more of the process temperatures in the process zone; the apparatus further comprising a programmable microprocessor control unit operatively associated with and controlling at least in part each of said one or more process control loops; the method comprising:

a. storing a temperature control profile in the control unit, said temperature control profile having a plurality of control profile sectors, each sector corresponding to one of said plurality of process regions in the process zone;

b. receiving at the control unit the signals from the plurality of temperature sensors;

c. the control unit determining from said signals the temperature for each of the plurality of process regions in the process zone;

d. the control unit making a comparison between the temperature of each process region and its corresponding control profile sector temperature;

e. the control unit identifying from said comparison each process region that is out of temperature compliance with its corresponding control profile sector;

f. the control unit identifying two or more of said plurality of process control loops configured to regulate at least in part the temperature of each such noncompliant process region, at least one of said two or more process control loops is configured to regulate at least in part the temperature of a plurality of such noncompliant process regions; and g. the control unit simultaneously controlling the operation of said two or more process control loops to collectively adjust the temperature of said two or more noncompliant process regions so as to substantially bring said noncompliant process regions into temperature compliance with the temperature control profile.

13. The method of claim 12, wherein at least one of said two or more process control loops is configured to regulate at least in part the temperature of all such noncompliant process regions.

14. The method of claim 12, wherein all of said two or more process control loops are configured to regulate at least in part the temperature of a plurality of such noncompliant process regions.

15. The method of claim 12, wherein the temperature control profile comprises a temperature range for one of said process regions within the process zone.

16. The method of claim 12, wherein the process zone comprises a delacquering zone.

* * * * *

UNITED STATES PATENT AND TRADEMARK OFFICE

CERTIFICATE OF CORRECTION

PATENT NO. : 8,985,472 B2
APPLICATION NO. : 13/111633
DATED : March 24, 2015
INVENTOR(S) : John M. Peterman and Mark A. Roberts It is certified that error appears in the above-identified patent and that said Letters Patent is hereby corrected as shown below:

IN THE CLAIMS:

In Column 7, line 27, delete “vii;”.

In Column 7, line 28, replace “viii. an exhaust damper control loop;” with --vii. an exhaust damper control loop--.

In Column 7, line 29, replace “xi. an emergency vent control loop; and/or;” with --viii. an emergency vent control loop; and/or--.

In Column 7, line 30, replace “x. an oxygen control loop;” with --ix. an oxygen control loop--.

Signed and Sealed this
Eleventh Day of August, 2015

Michelle K. Lee

Michelle K. Lee
*Director of the United States Patent and Trademark Office*